US007395022B2

(12) United States Patent
Yuasa et al.

(10) Patent No.: US 7,395,022 B2
(45) Date of Patent: Jul. 1, 2008

(54) IMAGE FORMING APPARATUS WITH TONER RECOVERY SYSTEM

(75) Inventors: Koichiro Yuasa, Ebina (JP); Yasuhiro Oda, Ebina (JP); Akihisa Maruyama, Ebina (JP); Miho Ikeda, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 332 days.

(21) Appl. No.: 11/212,847

(22) Filed: Aug. 29, 2005

(65) Prior Publication Data

US 2006/0216086 A1 Sep. 28, 2006

(30) Foreign Application Priority Data

Mar. 25, 2005 (JP) ..... 2005-089793

(51) Int. Cl.
*G03G 15/21* (2006.01)

(52) U.S. Cl. ..... 399/359; 399/101; 399/360

(58) Field of Classification Search ..... 399/101, 399/358, 359, 360, 34, 35
See application file for complete search history.

(56) References Cited

U.S. PATENT DOCUMENTS

| | | | | |
|---|---|---|---|---|
| 5,493,382 | A * | 2/1996 | Takagaki et al. | 399/359 |
| 5,906,906 | A * | 5/1999 | Inoue et al. | 430/119.88 |
| 6,418,291 | B1 * | 7/2002 | Sakemi | 399/257 |
| 6,711,374 | B2 * | 3/2004 | Funayama et al. | 399/359 |
| 7,043,190 | B2 * | 5/2006 | Tohata | 399/359 |
| 7,120,366 | B2 * | 10/2006 | Onodera et al. | 399/35 |

FOREIGN PATENT DOCUMENTS

| | | | |
|---|---|---|---|
| JP | 8-29740 | | 11/1996 |
| JP | 09034328 | A * | 2/1997 |
| JP | 10186987 | A * | 7/1998 |
| JP | 11237823 | A * | 8/1999 |
| JP | 11327272 | A * | 11/1999 |
| JP | 2002169443 | A * | 6/2002 |
| JP | 2002-341714 | | 11/2002 |
| JP | 2004020661 | A * | 1/2004 |

* cited by examiner

*Primary Examiner*—Robert Beatty
(74) *Attorney, Agent, or Firm*—Morgan, Lewis & Bockius LLP

(57) ABSTRACT

An image forming apparatus has an image carrier on which an electrostatic latent image is formed, a developing unit that develops the electrostatic latent image using a toner to form a toner image, and a cleaning unit that removes the toner remaining on the image carrier after transferring the toner image to a recording medium. The image forming apparatus includes a buffer housing unit that temporarily houses the toner removed by the cleaning unit, a first carrier unit comprising a carrier driving member, the first carrier unit provided between the cleaning unit and the buffer housing unit, and the first carrier unit carries the toner removed by the cleaning unit to the buffer housing unit using the a carrier driving member, a second carrier unit comprising a carrier driving member, the second carrier unit provided between the buffer housing unit and the developing unit, and the second carrier unit carries the toner housed in the buffer housing unit to the developing unit using the carrier driving member, a waste housing unit connected to the buffer housing unit, and a control unit that separately controls the carrier driving member of the first carrier unit and the carrier driving member of the second carrier unit, wherein the buffer housing unit has an upper limit of housing capacity, and the waste housing unit houses the toner exceeding the upper limit and overflowing from the buffer unit.

13 Claims, 8 Drawing Sheets

FIG. 4

| RATIO OF USE OF RETRIEVED TONER | FOG |
|---|---|
| 5% | G0 |
| 10% | G1 |
| 15% | G1 |
| 20% | G2 |
| 25% | G2 |
| 30% | G2 |
| 35% | G3 |
| 40% | G4 |

FIG. 8

| RATIO OF USE OF RETRIEVED TONER | FOG | SATURATION OF K COLOR |
|---|---|---|
| 5% | G0 | 0.5 |
| 10% | G1 | 1.0 |
| 15% | G2 | 1.5 |
| 20% | G2 | 2.2 |
| 25% | G3 | 3.0 |
| 30% | G4 | 3.5 |
| 35% | G4 | 4.7 |
| 40% | G4 | 5.2 |

IMAGE FORMING APPARATUS WITH TONER RECOVERY SYSTEM

BACKGROUND OF THE INVENTION (1) Field of the Invention

This invention relates to an image forming apparatus that forms an image made of toner such as a printer, a copy machine, or a multifunction machine having plural functions, and particularly to an image forming apparatus suitable for retrieving the toner remaining on an image carrier because of transfer failure or the like at the time of the image formation and effectively reusing a proper quantity of the retrieved toner.

(2) Description of the Related Art

In an image forming apparatus that forms an image using toner as a developer, since toner remains on an image carrier, an intermediate transfer member and the like because of transfer failure or the like at the time of the image formation, removal of the toner by a cleaning device, recirculation of the toner to a developing device and reuse of the toner have been attempted.

For example, in order to address the problem of continuous increase of retrieved toner with the lapse of time while retrieving toner remaining on an image carrier by a cleaner unit and effectively reusing the retrieved toner, the present applicant has previously proposed an image forming apparatus having a waste toner housing unit that houses the toner retrieved by the cleaner unit and carried by a second carrier unit, and a control unit that controls the supply ratio of unused toner and retrieved toner supplied to a developing unit in accordance with a cumulative value of pixel count of image information.

Also, in order to properly process retrieved toner even when the quantity of retrieved toner supplied from a cleaning device exceeds the processing capacity of a classifying device in an image forming apparatus having a toner recycle classifying device that classifies impurities from toner retrieved by the cleaning device, there has been proposed an image forming apparatus having an excessive retrieved toner processing unit that is arranged near the classifying unit and processes excessively supplied retrieved toner, and a quantifying wall that is arranged between the classifying unit and the excessive retrieved toner processing unit and causes the quantity of retrieved toner exceeding the processing capacity of the classifying device to overflow to the excessive retrieved toner processing unit.

However, these proposed image forming apparatuses have the following problems.

In the former image forming apparatus, the second carrier unit that carries the retrieved toner to the waste toner housing unit is provided in the state of being branched from the cleaning unit, and the second carrier unit is driven while its operation is controlled. Therefore, the structure of the apparatus is complicated accordingly. Also, since the operation to carry the retrieved toner to the waste toner housing unit need to be controlled, the control operation is complicated. Moreover, since the quantity of the retrieved toner to be supplied to the developing unit is controlled in accordance with the cumulative value of pixel count or the like, the control operation is further complicated. Such complexity may be increased further when applied to a color image forming apparatus in which plural image carriers are arranged.

On the other hand, in the latter image forming apparatus, measures to prevent clogging or the like and maintenance and inspection of the classifying unit are necessary. Also, the structure of the classifying unit itself is complicated and large-scaled. Moreover, since the quantity of the classified retrieved toner to be supplied to the developing unit is not particularly adjusted, the rate of use of the retrieved toner increases and may cause occurrence of defective image quality such as image fog. Furthermore, there is another problem that the quantity of the retrieved toner to be supplied to the developing unit depends on the processing capacity of the classifying unit.

SUMMARY OF THE INVENTION

This invention has been made in view of the above circumstances and provides an image forming apparatus.

According to an aspect of this invention, An image forming apparatus comprises an image carrier on which an electrostatic latent image is formed, a developing unit that develops the electrostatic latent image using a toner to form a toner image, and a cleaning unit that removes the toner remaining on the image carrier after transferring the toner image to a recording medium, and the image forming apparatus comprises:

a buffer housing unit that temporarily houses the toner removed by the cleaning unit;

a first carrier unit comprising a carrier driving member, the first carrier unit provided between the cleaning unit and the buffer housing unit, and the first carrier unit carries the toner removed by the cleaning unit to the buffer housing unit using the carrier driving member;

a second carrier unit comprising a carrier driving member, the second carrier unit provided between the buffer housing unit and the developing unit, and the second carrier unit carries the toner housed in the buffer housing unit to the developing unit using the carrier driving member;

a waste housing unit connected to the buffer housing unit;

a control unit that separately controlls the carrier driving member of the first carrier unit and the carrier driving member of the second carrier unit, wherein the buffer housing unit has an upper limit of housing capacity of the toner, and the waste housing unit houses the toner exceeding the upper limit and overflowing from the buffer housing unit.

BRIEF DESCRIPTION OF THE DRAWINGS

Embodiments of the invention will be described in detail based on the following figures, wherein:

FIG. 4 is a table showing the result of a test carried out in the first embodiment;

FIG. 8 is a table showing the result of a test carried out in the second embodiment.

DETAILED DESCRIPTION OF THE INVENTION

First Embodiment

Figure 1:
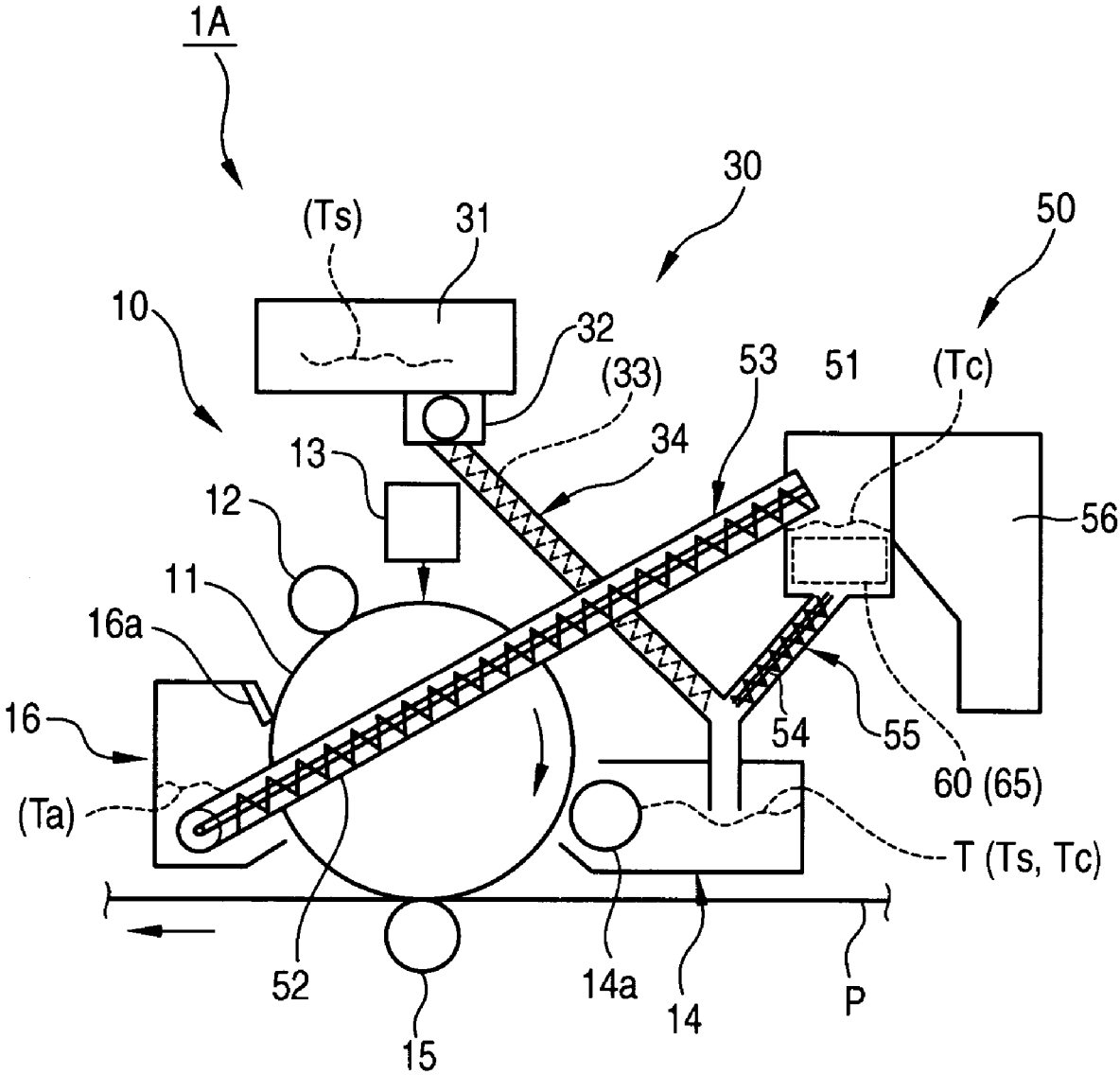
FIG. 1 is a schematic explanatory view showing an overall structure of an image forming apparatus according to a first embodiment.

FIG. 1 shows an image forming apparatus according to a first embodiment of this invention.

In this image forming apparatus 1A, its image creating unit 10 basically includes a photosensitive drum 11 having an organic photosensitive layer or the like formed on an outer circumferential surface of a drum base rotationally driven in the direction of an arrow at a predetermined speed, a charging unit 12 that uniformly charges the surface of this photosensitive drum 11, a latent image forming unit 13 that exposes light corresponding to image information to the charged surface of the photosensitive drum 11 and forms an electrostatic latent image thereon, a developing unit 14 that develops the electrostatic latent image using a developer (toner) of a predetermined color (in this example, black), a primary transfer unit 15 that electrostatically transfers the toner image formed by the development to a recording paper P as a recording medium, and a drum cleaning unit 16 of a blade mode that cleans the surface of the photosensitive drum 11. As the developing unit 14, a two-component developing unit is used that uses a two-component developer made of toner and carrier.

In the image creating unit 10 as described above, after the surface of the photosensitive drum 11 rotated in the direction of the arrow is uniformly charged by the charging unit 12, light beams corresponding to color-separated image signals are exposed from the latent image forming unit 13 to scan the charged surface, thus writing an electrostatic latent image thereon. After the latent image is developed by toner T, which is a two-component developer, carried on a development roll 14*a* and supplied from the developing unit 14, and a black toner image is thus formed, the toner image is electrostatically transferred to the recording paper P passing between the photosensitive drum 11 and the primary transfer unit. The surface of the photosensitive drum 11 after this transfer is cleaned by having remaining toner Ta, paper particles and the like removed by a blade 16*a* of the drum cleaning unit 16.

Next, after the recording paper P, to which the toner image has been transferred, is fed into a fixing unit, not shown, and fixing of the toner image is performed, the recording paper P is discharged to a discharge unit outside of the apparatus. Basic image formation is performed through such an image forming process.

Also, in this image forming apparatus 1A, a toner supply unit 30 that supplies each proper quantity of unused toner Ts to the developing unit 14 when necessary, and a toner reuse system 50 that reuses toner Tc removed and retrieved by the drum cleaning unit 16.

The toner supply unit 30 mainly includes a toner cartridge 31 in which unused toner Ts is housed, a toner send-out driving unit 32 that sends out a predetermined quantity of the unused toner Ts in the toner cartridge 31 toward the developing unit 14 at predetermined timing, and an unused toner carrier pipe 34 installed to be connected between the toner send-out driving unit 32 and the developing unit 14 and having an auger (carrier member formed by a carrier blade continuing spirally around a shaft) 33 that is rotationally driven inside and sends the toner Ts, as shown in FIG. 1. The operation of the toner supply unit 30 is controlled by a control unit (70), which will be described later.

Figure 2:
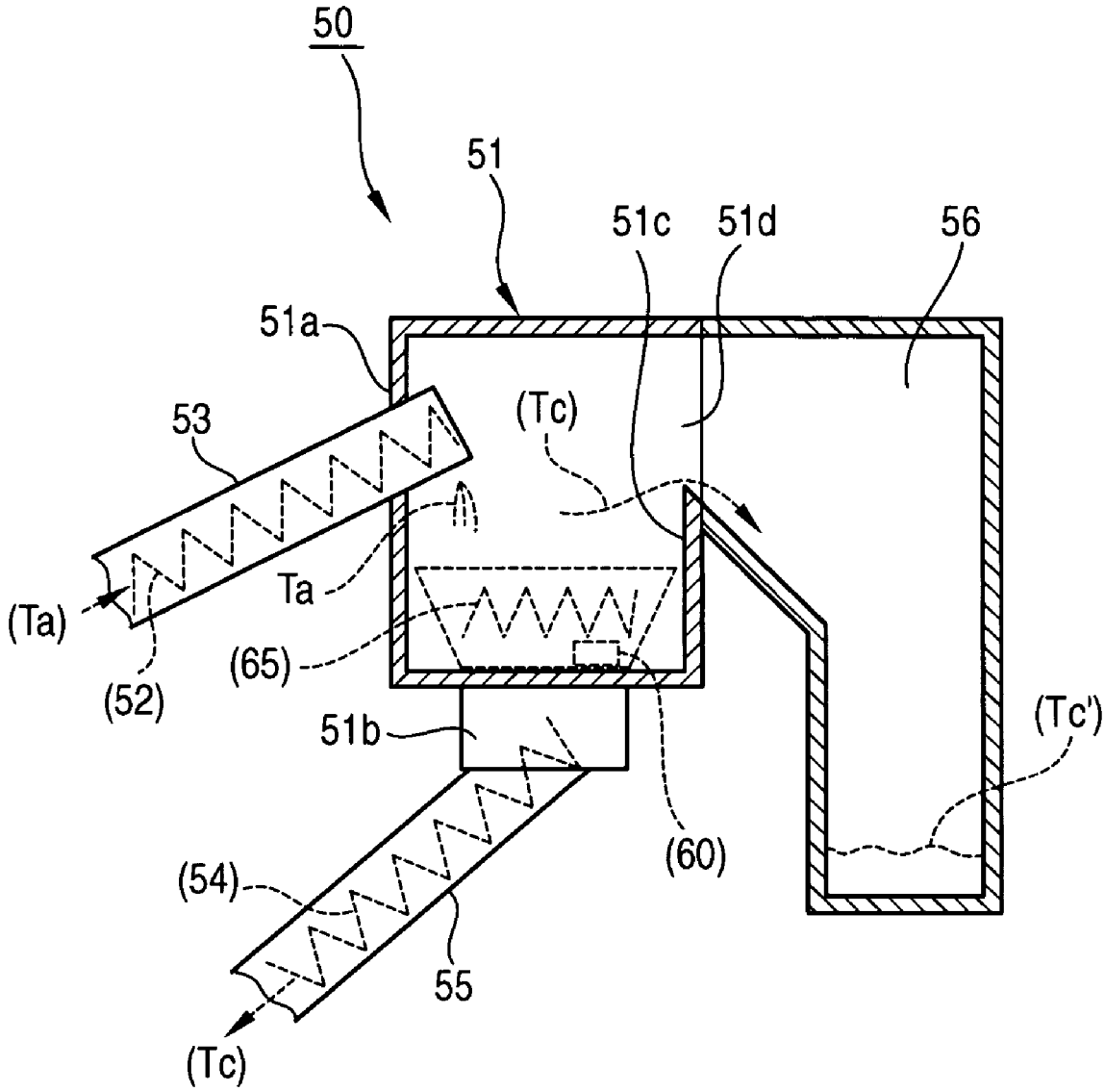
FIG. 2 is a schematic explanatory view showing essential parts of a toner reuse system in the image forming apparatus shown in FIG. 1.

The toner reuse system 50 mainly includes a buffer container 51 for temporarily housing toner Ta removed by the drum cleaning unit 16, a first carrier pipe 53 for carrying the toner Ta removed by the cleaning unit 16 to the buffer container 51 by an auger 52 rotationally driven within the pipe, a second carrier pipe 55 for carrying retrieved toner Tc housed in the buffer container 51 to the developing unit 14 by an auger 54 rotationally driven within the pipe, and a waste housing bottle 56 that causes retrieved toner Tc' exceeding an upper limit of housing capacity of the buffer container 51 to overflow and houses the overflowed toner, as shown in FIGS. 1 and 2.

The buffer container 51 has a housing capacity that enables temporary housing of the toner Tc removed by the drum cleaning unit 16, as shown in FIG. 2. This buffer container 51 has a connection and attachment part 51*a* for the first carrier pipe 53, on its upper lateral side, and a connection and attachment part 51*b* for the second carrier pipe 55, on its bottom side, as shown in FIG. 2. At a part of the lateral side of the container 51, an upper limit prescription lateral surface 51*c* having a height equivalent to the upper limit of housing capacity with respect to the toner Tc to be housed, and a toner discharge opening 51*d* continuing to the waste housing bottle 56 is formed above the upper limit prescription lateral surface 51*c*.

The first carrier pipe 53 is provided between the drum cleaning unit 16 and the buffer container 51. Its auger 52 is connected to an auger provided within a toner housing part of the cleaning unit 16 and is provided up to a position where it can reach inside of the buffer container 51 from the connection and attachment part 51*a* of the buffer container 51. The auger 52 is rotationally driven by an electric motor, not shown, in a direction of carrying the toner. As this auger 52 is rotationally driven, the toner Ta is carried through the pipe 53. The rotational driving of the auger 52 (electric motor) is controlled by the control unit (70), which will be described later.

The second carrier pipe 55 is provided between the buffer container 51 and the developing unit 14. In this example, the connection side of the carrier pipe 55 to the buffer container 51 is connected to the connection and attachment part 51*b*, whereas the connection part to the developing unit 14 is not directly connected to the developing unit 14 but is merged into a halfway part of the unused toner carrier pipe 34 in the toner supply unit 30. The auger 54 is rotationally driven by an electric motor, not shown, in a direction of carrying the toner Tc. As this auger 54 is rotationally driven, the toner Tc is carried through the pipe 55. The rotational driving of the auger 54 (electric motor) is controlled separately from the auger 52 by the control unit (70), which will be described later.

The waste housing bottle 56 has a housing capacity large enough to house the retrieved toner Tc exceeding the upper limit of housing capacity of the buffer container 51 (getting beyond the upper limit prescription lateral surface 51*c*) and overflowing thereto. The waste housing bottle 56 is provided in a state of continuing to the toner discharge opening 51*d* of the buffer container 51.

Also, on the bottom side of the housing space of the buffer container 51, a removing unit 60 that is driven to remove waste such as paper particles from the retrieved toner Tc housed in the buffer container 51 is installed. The removing unit 60 is formed, for example, by an ultrasonic generator that applies very small vibrations to the toner existing in the container 51. As the very small vibrations are applied, the waste attached to the retrieved toner can be separated and segregated to move toward the upper side of the container 51.

Moreover, in the buffer container 51, a stir-driving unit 65 that stirs the retrieved toner Tc housed in the buffer container 51 is installed instead of or together with the removing unit 60. The stir-driving unit 65 is not particularly limited as long as it can stir the retrieved toner Tc. For example, a stir-driving unit having a stirring member formed by shaping a wire member into a coil-like form or crank-like form and caused to rotate within the container is employed.

Figure 3:
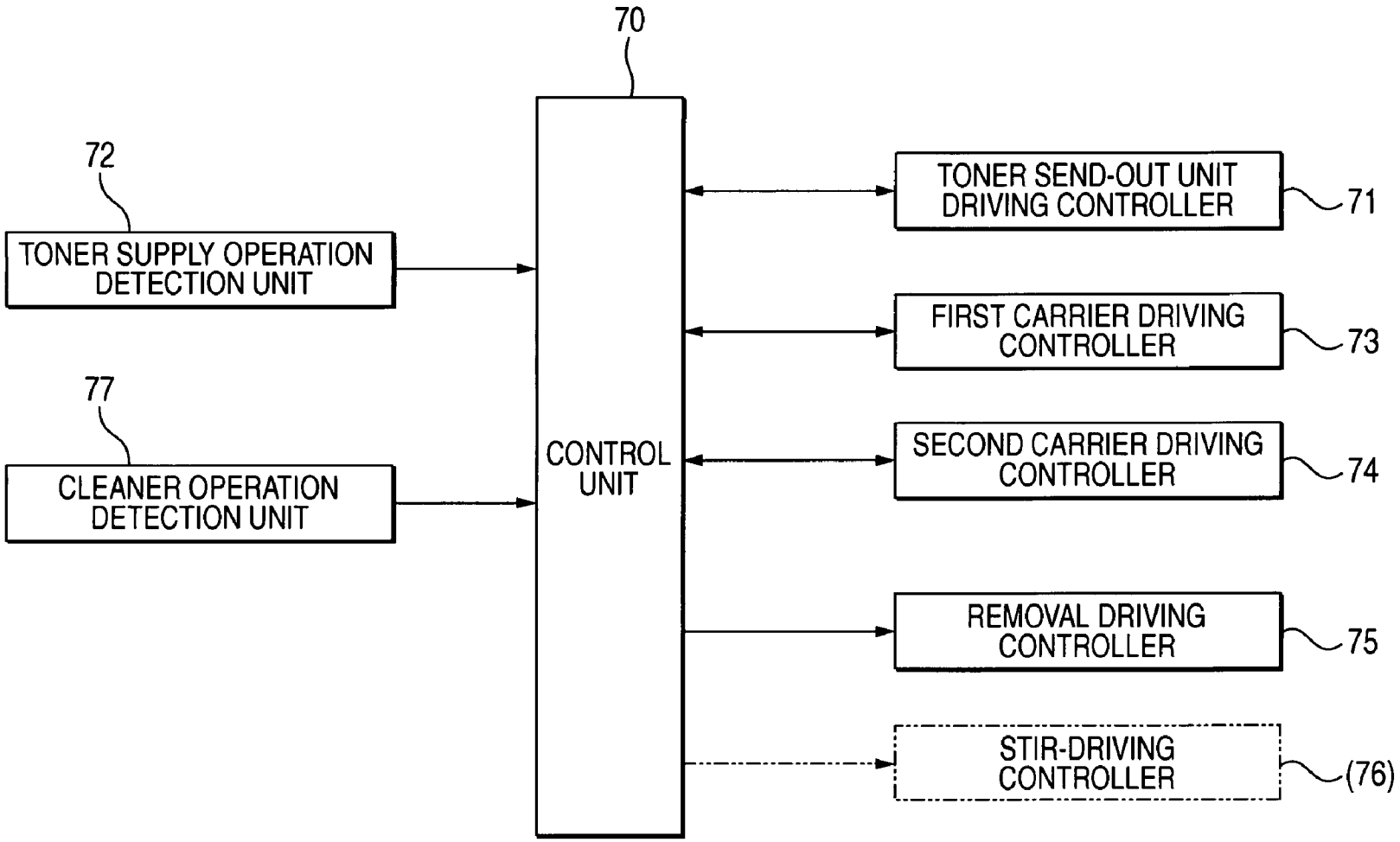
FIG. 3 is a block diagram showing principal constituent parts of a control system of the image forming apparatus shown in FIG. 1.

FIG. 3 shows a configuration of a control system that controls each operation of this image forming apparatus 1A. A numeral 70 in FIG. 3 represents a control unit 70 formed by a microcomputer including a storage unit or the like. The control unit 70 controls the operation of the above-described image creating unit or the like in the image forming process and also controls each operation of the above-described toner supply unit 30 and toner reuse system 50.

The control of the supply unit 30 by the control unit 70 is performed via a driving controller 71 that controls the driving unit for the toner send-out driving unit 32 in the supply unit 30. Specifically, in this control, the control unit 70 receives signals from a toner supply detection unit 72 that gathers necessary detection signals for determination of toner supply, including a detection signal from a sensor that detects the presence/absence of toner in the developing unit 14 and a detection signal from a detection sensor that detects a patch image for density control formed on the photosensitive drum 11 through process control, then calculates the timing to supply the unused toner Ts and the quantity of the unused toner Ts to be supplied in accordance with a control program stored in advance in a storage unit, and sends a necessary control signal to the driving controller 71 for the toner send-out driving unit.

The control of the toner reused system 50 by the control unit 70 is performed via a first carrier driving controller 73 that controls the driving unit for the auger 52 in the first carrier pipe 53, a second carrier driving controller 74 that controls the driving unit for the auger 54 in the second carrier pipe 55, a removal driving controller 75 that controls the driving unit for the removing unit 60, and a stir-driving controller 76 that controls the driving unit for the stir-driving unit 65, which is provided when necessary.

Specifically, in this control, with respect to the first carrier driving controller 73, when the control unit 70 receives a detection signal from a cleaner operation detection unit 77 that detects the timing of operation (driving of the auger or the like) of the drum cleaning unit 16, in accordance with a toner reuse system control program stored in advance in the storage unit, a control signal that drives the first carrier driving controller 73 synchronously with the operation timing of the cleaning unit 16 is sent. The operation timing of the cleaning unit 16 is substantially the same as the execution timing of the image forming process. With respect to the second carrier driving controller 74, when a signal is received from the toner supply detection unit 72, a control signal that drives the second carrier driving controller 74 synchronously with the operation timing of the toner supply is sent. With respect to the removal driving controller 75 (and the stir-driving controller 76), the same control signal as the control signal for the first carrier driving controller 73 is sent at the same time.

Each operation of the toner supply unit 30 and the toner reuse system 50 as described above will now be described.

In this image forming apparatus 1A, every time the image forming process as described above is executed, the toner T in the developing unit 14 is consumed and reduced. Therefore, when a signal determining that toner supply is necessary is sent to the control unit 70 from the toner supply detection unit 72, a control signal related to the timing to supply the unused toner Ts and the quantity of the unused toner Ts to be supplied is sent to the driving controller 71 in the toner supply unit 30 from the control unit 70.

This causes the toner send-out driving unit 32 to start the operation of its driving unit and thus to drive the auger 33 in the unused toner carrier pipe 34 at predetermined timing and for a predetermined period. As a result, the unused toner Ts in the toner cartridge 31 in the toner supply unit 30 is carried and supplied to the developing unit 14 through the unused toner carrier pipe 34 by the rotationally driven auger 33. As the predetermined period has elapsed, the rotational driving of the auger 33 stops and thus the supply of the unused toner Ts ends.

Also, in the image forming apparatus 1A, when the above-described image forming process is executed, the toner Ta remaining on the surface of the photosensitive drum 11 after the transfer is removed by the drum cleaning unit 16. When the operation of this drum cleaning unit 16 is started, a detection signal from the cleaner operation detection unit 77 is sent to the control unit 70 and a driving signal is sent from the control unit 70 to the first carrier driving controller 73 in the toner reuse system 50.

This causes the first carrier driving controller 73 to start the operation of its driving unit and thus to rotationally drive the auger 52 in the first carrier pipe 53. As a result, in the toner reuse system 50, the toner Ta removed by the drum cleaning unit 16 is carried to the buffer container 51 through the first carrier pipe 53 by the rotationally driven auger 52 and then housed in the buffer container 51. When the image forming processing is ended, the rotational driving of the auger 52 stops and thus carrying the toner Ta to the buffer container 51 stops.

Along with the rotational driving of the auger 52 in this first carrier pipe 53, a driving signal is sent from the control unit 70 to the removal driving controller 75 (and the stir-driving controller 76). This starts the operation of the removing unit 60 in the buffer container 51 of the toner reuse system 50, and waste is separated and removed from the retrieved toner Tc housed in the container 51. When the stir-driving unit 65 is provided, the stir-driving unit 65 starts operating and the retrieved toner Tc housed in the container 51 is stirred. The retrieved toner is thus prevented from aggregating in the container 51.

On the other hand, when a signal requesting toner supply is sent from the toner supply detection unit 72 to the control unit 70, a driving signal is also sent from the control unit 70 to the second carrier driving controller 74 of the toner reuse system 50.

This causes the second carrier driving controller 74 to start the operation of its driving unit and thus to rotationally drive the auger 54 in the second carrier pipe 55. As a result, the retrieved toner Tc housed in the buffer container 51 is carried toward the developing unit 14 through the second carrier pipe 55 by the rotationally driven auger 54. Since the retrieved toner Tc carried through this second carrier pipe 55 merges into the unused toner carrier pipe 34 in the toner supply unit 30, the retrieved toner Tc is carried to the developing unit 14 as it is mixed with the unused toner Ts. Thus, the retrieved toner Tc is supplied to and reused in the developing unit 14 as it is mixed with the unused toner Ts. The quantity of the retrieved toner Tc to be supplied is substantially determined by the rotational driving time of the auger 54. When the toner supply operation ends, the auger 54 stops its rotational driving and thus carrying the retrieved toner Tc to the developing unit 14 stops.

In this toner reuse system 50, when the quantity of the retrieved toner Tc carried to and housed in the buffer container 51 through the first carrier pipe 53 exceeds the upper limit prescription lateral surface 51*c* in the container 51, the retrieved toner Tc' corresponding the excess quantity automatically gets beyond the upper limit prescription lateral surface 51*c* and overflows to be housed in the waste housing bottle 56 through the toner discharge opening 51*d*. A test carried out by using the image forming apparatus 1A having this toner reuse system 50 will now be described.

In this test, the same test image is formed on 10,000 recording papers P by the image forming apparatus 1A. After that, a predetermined quantity of unused toner Ts is supplied to the developing unit 14 from the toner supply unit 30, and toner is sequentially supplied while the ratio (%) of retrieved toner Tc supplied from the buffer container 51 to the quantity of the supplied unused toner is increased by 5% each. The occurrence of image fog in each test image that is newly formed after the toner is supplied at each ratio is observed. Then, the occurrence of image fog is evaluated on the basis of the following evaluation standards. The result of the evaluation is shown in FIG. 4.

The setting conditions in this test are as follows. As the toner T, the toner used for a color copy machine (DocuCenter Color 400CP manufactured by Fuji Xerox Co., Ltd.) is used. As the test image, an image having an image density of 10% is used.

[Evaluation Standards]

G0: The area coverage of image fog is 0.191% or less.
G1: The area coverage of image fog is 0.971% or less.
G2: The area coverage of image fog is 1.98% or less.
G3: The area coverage of image fog is 2.43% or less.
G4: The area coverage of image fog is 4.3% or less.

The acceptable level in this evaluation is "G2 or lower".

From the result of this test, in the toner reuse system 50, the quantity of the retrieved toner Tc to be supplied to the developing unit 14 from the buffer container 51 is set to achieve 30% or less as the ratio of the retrieved toner to the quantity of the unused toner to be supplied. Specifically, a control signal is sent to the second carrier driving controller 74 to supply 0.3 times or less as much retrieved toner Tc as the quantity of the unused toner to be supplied that is recognized in the toner supply unit 30. Also, in this case, the unused toner is supplied under a condition that the quantity of the retrieved toner Tc to be supplied is subtracted from the original quantity of supply.

Second Embodiment

Figure 5:
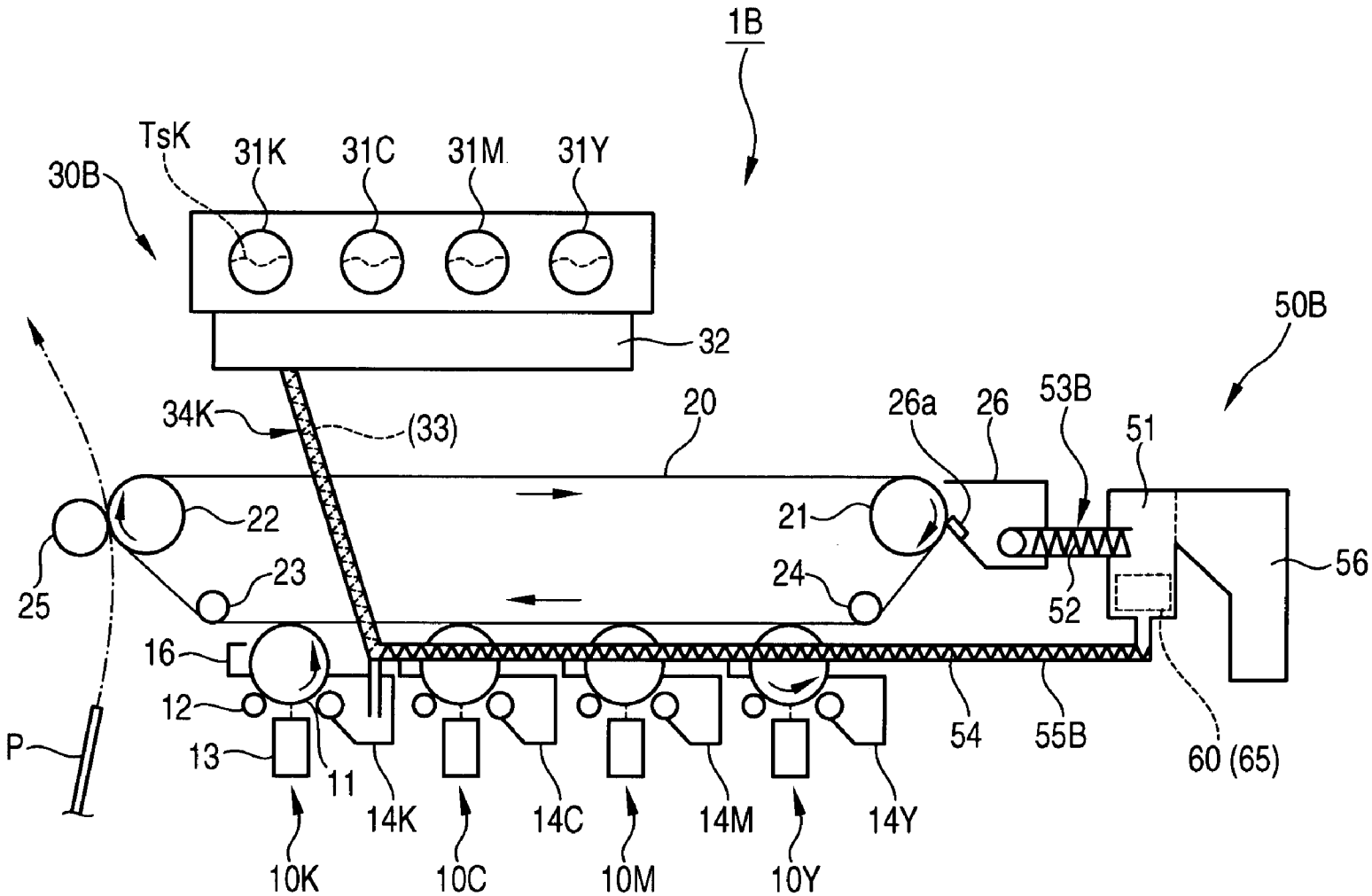
FIG. 5 is a schematic explanatory view showing an overall structure of a color image forming apparatus according to a second embodiment.

FIG. 5 shows an image forming apparatus according to a second embodiment of this invention.

This image forming apparatus 1B has plural image creating units 10 and employs an intermediate transfer mode to enable formation of a color image. Therefore, the image forming apparatus 1B has the same configuration as the image forming apparatus 1A according to the first embodiment except that a part of the configuration of the toner reuse system 50 is changed.

First, this color image forming apparatus 1B has four image creating units 10Y, 10M, 10C and 10K that are dedicated to forming toner images of four colors, that is, yellow (Y), magenta (M), cyan (C) and black (K), respectively. The toner images of the four colors formed by the individual image creating units 10 (Y, M, C, K) are primarily transferred to overlap each other on the surface of an intermediate transfer belt 20. After that, the transferred image is secondarily transferred from the intermediate transfer belt 20 to a recording paper P as a recording medium. Thus, a so-called full-color image can be formed.

Each of the image creating units 10 is basically similar to the image creating unit in the first embodiment and includes a photosensitive drum 11 having an organic photosensitive layer or the like formed on the outer circumferential surface of a drum base that is rotationally driven in the direction of an arrow at a predetermined speed, a charging unit 12 that uniformly charges the surface of this photosensitive drum 11, a latent image forming unit 13 that exposes light corresponding to image information to the charged surface of the photosensitive drum 11 and thus forms an electrostatic latent image thereon, a developing unit 14 that develops the electrostatic latent image by using a developer of predetermined color (one of Y, M, C and K), a primary transfer unit 15 that electrostatically transfers the toner image formed by the development to the intermediate transfer belt 20, and a drum cleaning unit 16 of a blade mode that cleans the surface of the photosensitive drum 11.

Next, the intermediate transfer belt 20 is an endless belt having a double-layer structure formed by stacking a surface layer of silicone rubber or the like on a belt base made of a polyimide film or the like with its volume resistivity adjusted by containing a conductive material or the like. The intermediate transfer belt 20 is tensioned on a driving roll 21, a backup roll 22 of a secondary transfer unit, plural slave rolls 23, 24 and the like, and is arranged to contact the photosensitive drums 11 of the individual image creating units 10 (Y, M, C, K) between the slave rolls 23 and 24. The intermediate transfer belt 20 travels in a rotating manner in the direction of an arrow by the rotational power of the driving roll 21. The slave roll 23 is a tension roll that applies predetermined tension to the intermediate transfer belt 20.

Around this intermediate transfer belt 20, a secondary transfer roll 25 that presses the intermediate transfer belt 20 to the backup roll 22 to form a pressure contact area of the secondary transfer unit is provided. At a position on the intermediate transfer belt 20 facing the driving roll 21, a belt cleaning unit 26 of a blade mode that cleans the surface of the belt 20 is provided.

In each of the image creating units 10 (Y, M, C, K) as described above, after the surface of the photo sensitive drum 11 rotating in the direction of the arrow is uniformly charged by the charging unit 12, a light beam corresponding to a color-separated image signal is exposed from the latent image forming unit 13 to scan the charged surface, thus writing an electrostatic latent image thereon. Then, after the latent image is developed by toner, which is a two-component developer, supplied from the developing unit 14, and a toner image of predetermined color is formed, the toner image is primarily transferred sequentially and electrostatically onto the surface of the intermediate transfer belt 20 passing between the photosensitive drum 11 and a transfer roll 15*a* of the primary transfer unit. The surface of the photosensitive drum 11 after the primary transfer is cleaned as the remaining toner or the like is removed from the surface of the photosensitive drum 11 by the blade of the drum cleaning unit 16.

The toner image transferred (multiple-transferred) on the intermediate transfer belt 20 as described above is carried by the rotation of the belt 20 to the secondary transfer unit that faces the secondary transfer roll 25 arranged to face the backup roll 22. Then, in the secondary transfer unit, the toner image on the intermediate transfer belt 20 is secondarily transferred electrostatically onto a recording paper P transported to the secondary transfer unit from a paper feeder system, not shown, at predetermined timing in accordance with the timing of the image creation of the toner image and the timing of the secondary transfer. The surface of the intermediate transfer belt 20 after the secondary transfer is cleaned as the remaining toner Tb of each color component, paper particles and the like after the secondary transfer are removed from the surface of the intermediate transfer belt 20 by a blade 26*a* of the belt cleaning unit 26.

Next, the recording paper P on which the toner image has been transferred is fed into a fixing unit, not shown, and the toner image is fixed. After that, the recording paper P is discharged to a discharge unit outside of the apparatus. A basic color image is formed through such an image forming process.

This image forming apparatus 1B also has a toner supply unit 30B that supplies each proper quantity of unused toner Ts (Y, M, C, K) of each color to the four developing units 14 (Y, M, C, K) when necessary, and a toner reuse system 50B that reuses toner Tc removed and retrieved by the belt cleaning unit 26.

The toner supply unit 30B mainly includes toner cartridges 31 (Y, M, C, K) in which the unused toner Ts of each color is housed, a toner send-out driving unit 32 that sends out a predetermined quantity of the unused toner Ts of each color in each of the toner cartridges 31 toward the developing units 14 at predetermined timing, and unused toner carrier pipes 34 installed to be connected between the toner send-out driving unit 32 and each of the developing units 14 (Y, M, C, K) and having an auger 33 that is rotationally driven inside and sends the toner Ts. As for the toner carrier pipes 34, only the unused toner carrier pipe for black (K) is shown in FIG. 5 while the unused toner carrier pipes for the other colors are not shown. The operation of this toner supply unit 30B is controlled by a control unit (70), which will be described later.

Figure 6:
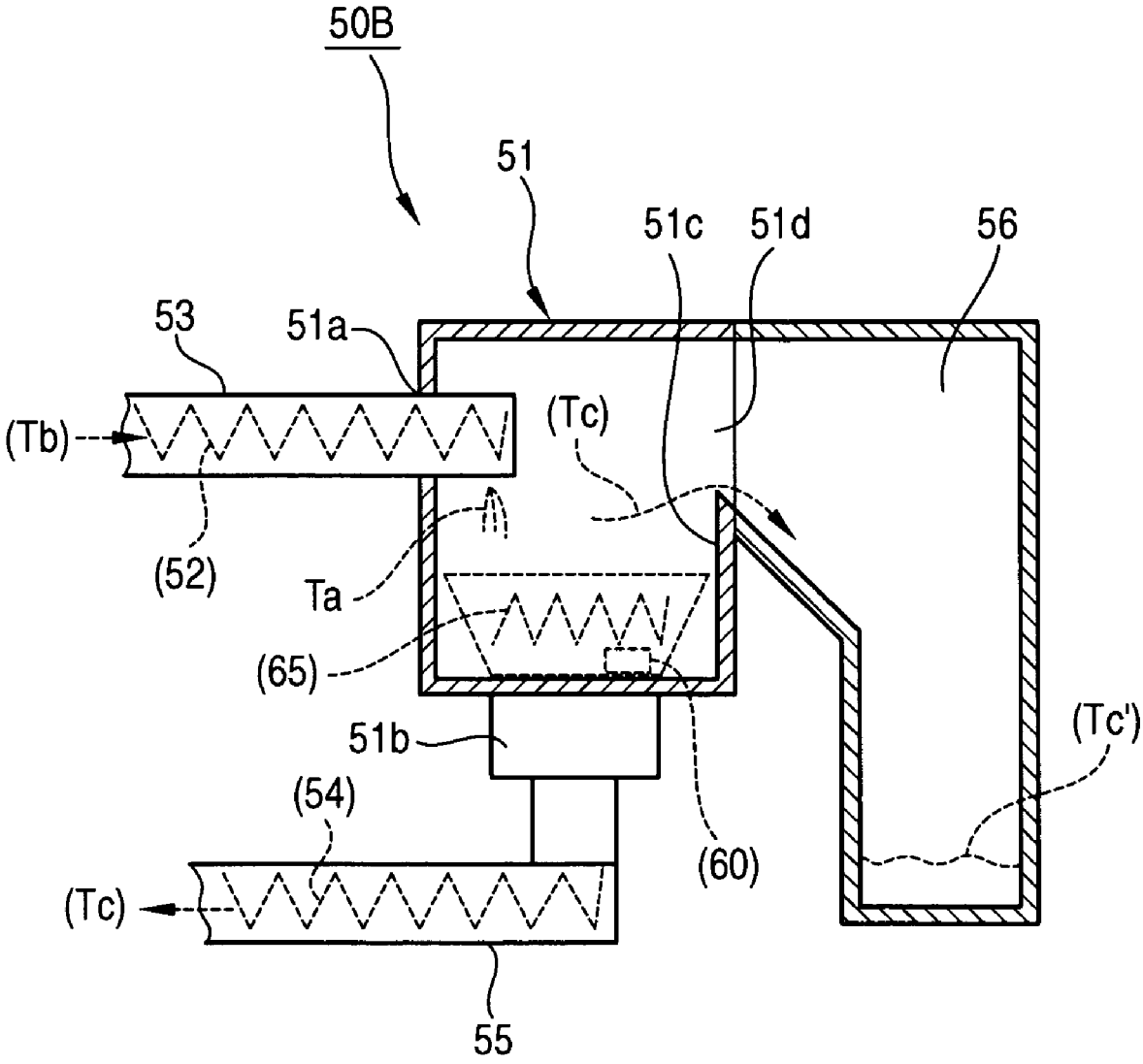
FIG. 6 is a schematic explanatory view showing essential parts of a toner reuse system in the image forming apparatus shown in FIG. 5.

The toner reuse system 50B mainly includes a buffer container 51 for temporarily housing toner Tb removed by the belt cleaning unit 26, a first carrier pipe 53B for carrying the toner Tb removed by the cleaning unit 26 to the buffer container 51 by an auger 52 rotationally driven within the pipe, a second carrier pipe 55B for carrying retrieved toner Tc housed in the buffer container 51 to the black developing unit 14K by an auger 54 rotationally driven within the pipe, and a waste housing bottle 56 that causes retrieved toner Tc' exceeding an upper limit of housing capacity of the buffer container 51 to overflow and houses the overflowed toner, as shown in FIGS. 5 and 6.

The buffer container 51, the first carrier pipe 53B, the second carrier pipe 55B and the waste housing bottle 56, which form this toner reuse system 50B, basically include the same constituent components as those of the toner reuse system 50 in the first embodiment. Particularly, also in this buffer container 51, a removing unit 60 and a stirring unit 65 may be installed when necessary, as in the buffer container of the toner reuse system 50 in the first embodiment.

However, the configuration of this toner reuse system is different from the configuration of the toner reuse system 50 in the first embodiment in that the first carrier pipe 53B is not connected to the drum cleaning unit 16 of the image creating unit 10 but to the belt cleaning unit 26 and that the second carrier pipe 55B is not connected to all the developing units 14 in the image creating units 10 but only to the black developing unit 14.

Figure 7:
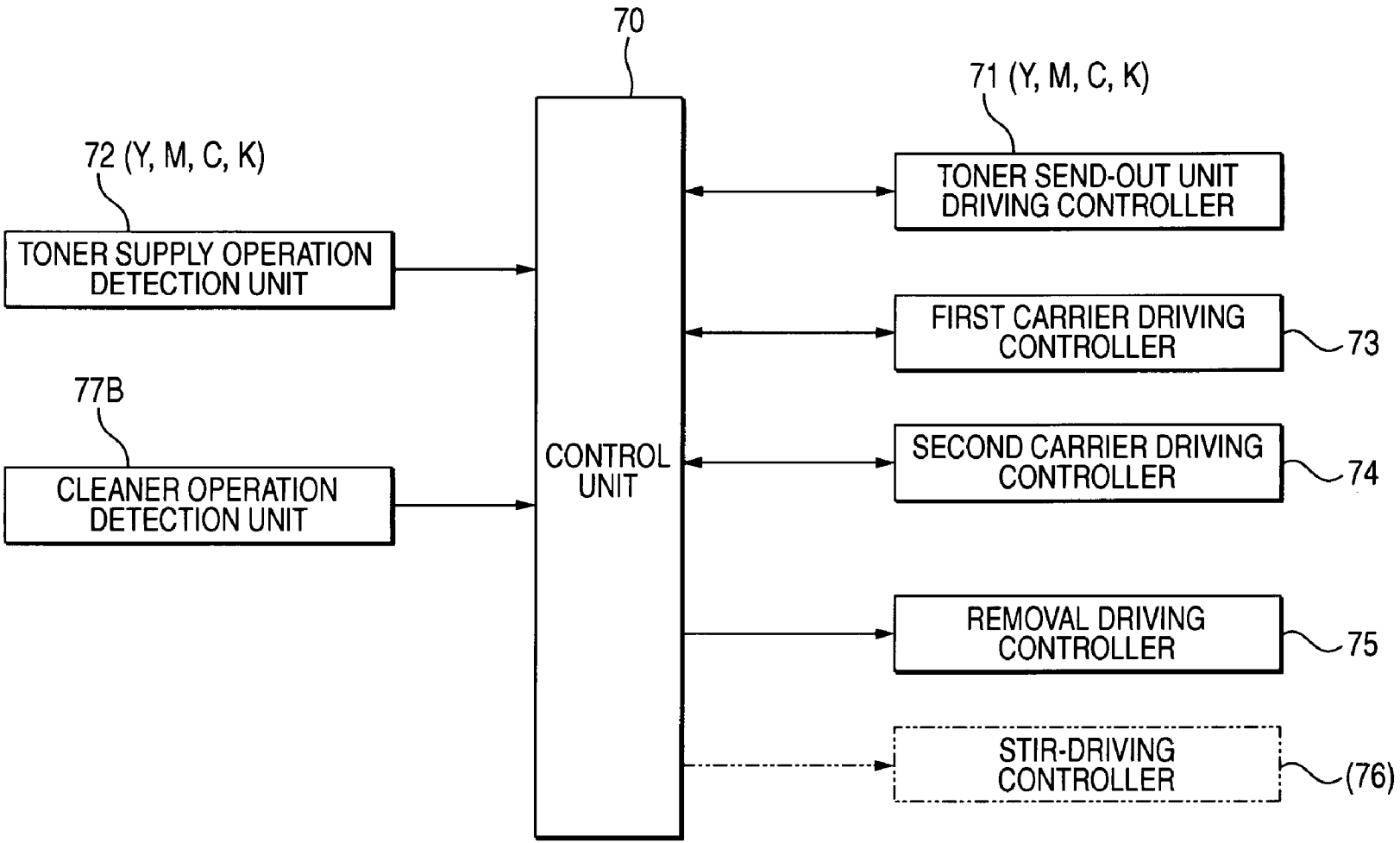
FIG. 7 is a block diagram showing principal constituent parts of a control system of the image forming apparatus shown in FIG. 5.

FIG. 7 shows a configuration of a control system that controls each operation of this image forming apparatus 1B. A numeral 70 in FIG. 7 represents a control unit 70, as in the configuration of the control system in the first embodiment. The control unit 70 controls the operation of each of the above-described image creating units or the like in the image forming process and also controls each operation of the above-described toner supply unit 30B and toner reuse system 50B.

The control of the toner supply unit 30B by the control unit 70 is performed via a driving controller 71 that controls the driving unit for the toner send-out driving unit 32 in the supply unit 30B. Specifically, in this control, basically the same control is performed as in the toner supply unit 30 in the first embodiment (see FIG. 3), except that a detection signal from a toner supply detection unit 72 (Y, M, C, K) of each color is received for performing similar control.

The control of the toner reused system 50B by the control unit 70 is performed via a first carrier driving controller 73, a second carrier-driving controller 74, a removal driving controller 75, and a stir-driving controller 76, which is provided when necessary, as in the control of the toner reuse system 50 in the first embodiment (see FIG. 3). Also in this control, basically the same control as the control of the toner reuse system 50 in the first embodiment is performed. The control in this embodiment is different from the first embodiment in that only for the first carrier driving controller 73, when a detection signal is received from a cleaner operation detection unit 77B that detects the timing of operation (driving of the auger or the like) of the belt cleaning unit 26, a control signal that drives the first carrier driving controller 73 synchronously with the operation timing of the cleaning unit 26 is sent. The operation timing of the cleaning unit 26 is substantially the same as the execution timing of the image forming process.

Each operation of the toner supply unit 30B and the toner reuse system 50B as described above will now be described.

In this image forming apparatus 1B, every time the image forming process as described above is executed, each toner T in the developing unit 14 (Y, M, C, K) of each image creating unit 10 is consumed and reduced. Therefore, when a signal determining that toner supply is necessary is sent to the control unit 70 from each of the toner supply detection units 72 (Y, M, C, K), a control signal related to the type of toner (color) of unused toner Ts to be supplied, the timing to supply the unused toner Ts and the quantity of the unused toner Ts to be supplied is separately sent to each of the driving controllers 71 (Y, M, C, K) in the toner supply unit 30B from the control unit 70.

This causes the toner send-out driving unit 32 to start the operation of the driving unit of the supply target and thus to drive the auger 33 in the unused toner carrier pipe 34 at predetermined timing and for a predetermined period each. As a result, the unused toner Ts in the toner cartridge 31 (Y, M, C, K) of the supply target in the toner supply unit 30B is carried and supplied to the predetermined developing unit 14 (Y, M, C, K) through the unused toner carrier pipe 34 by the rotationally driven auger 33. As the predetermined period has elapsed, the rotational driving of the auger 33 stops and thus the supply of the unused toner Ts ends.

Also, in the image forming apparatus 1B, when the above-described image forming process is executed, the toner Tb remaining on the surface of the intermediate transfer belt 20 after the secondary transfer is removed by the belt cleaning unit 26. When the operation of this belt cleaning unit 26 is started, a detection signal from the cleaner operation detection unit 77B is sent to the control unit 70 and a driving signal is sent from the control unit 70 to the first carrier driving controller 73 in the toner reuse system 50B.

This causes the first carrier driving controller 73 to start the operation of its driving unit and thus to rotationally drive the auger 52 in the first carrier pipe 53. As a result, in the toner reuse system 50B, the toner Tb of mixed color components removed by the belt cleaning unit 26 is carried into the buffer container 51 through the first carrier pipe 53 by the rotationally driven auger 52 and then housed in the buffer container 51. Again, when the image forming processing or the like is ended, the rotational driving of the auger 52 stops and thus carrying the toner Tb to the buffer container 51 stops.

Along with the rotational driving of the auger 52 in this first carrier pipe 53, a driving signal is sent from the control unit 70 to the removal driving controller 75 (and the stir-driving controller 76). This starts the operation of the removing unit 60 in the buffer container 51 of the toner reuse system 50B, and waste is separated and removed from the retrieved toner Tc housed in the container 51. When the stir-driving unit 65 is provided, the stir-driving unit 65 starts operating and the retrieved toner Tc housed in the container 51 is stirred. The retrieved toner of mixed colors is thus prevented from aggregating in the container 51.

On the other hand, when a signal requesting toner supply of black (K) is sent from any of the toner supply detection units 72 (Y, M, C, K) to the control unit 70, a driving signal is also sent from the control unit 70 to the second carrier driving controller 74 of the toner reuse system 50B.

This causes the second carrier driving controller 74 to start the operation of its driving unit and thus to rotationally drive the auger 54 in the second carrier pipe 55. As a result, the retrieved toner Tc of mixed colors housed in the buffer container 51 is carried toward the black developing unit 14K through the second carrier pipe 55 by the rotationally driven auger 54. Since the retrieved toner Tc carried through this second carrier pipe 55 merges into the black unused toner carrier pipe 34K in the toner supply unit 30B, the retrieved toner Tc is carried to the developing unit 14 as it is mixed with black unused toner Tsk. Thus, the retrieved toner Tc is supplied to and reused in the black developing unit 14K as it is mixed with the black unused toner Tsk. The quantity of the retrieved toner Tc to be supplied is substantially determined by the rotational driving time of the auger 54. When the toner supply operation ends, the auger 54 stops its rotational driving and thus carrying the retrieved toner Tc to the black developing unit 14K stops.

In this toner reuse system 50B, as in the first embodiment, when the quantity of the retrieved toner Tc carried to and housed in the buffer container 51 through the first carrier pipe 53 exceeds an upper limit prescription lateral surface 51*c* in the container 51, the retrieved toner Tc' corresponding the excess quantity automatically gets beyond the upper limit prescription lateral surface 51*c* and overflows to be housed in the waste housing bottle 56 through the toner discharge opening 51*d*.

A test carried out by using the image forming apparatus 1B having this toner reuse system 50B will now be described.

In this test, the same test image is formed on 10,000 recording papers P by the image forming apparatus 1B. After that, a predetermined quantity of black unused toner Tsk is supplied to the black developing unit 14K from the toner supply unit 30B, and toner is sequentially supplied while the ratio (%) of retrieved toner Tc supplied from the buffer container 51 to the quantity of the supplied unused toner is increased by 5% each. The occurrence of image fog in each test image that is newly formed after the toner is supplied at each ratio is observed and the saturation (C*) of black image is examined. Then, the occurrence of image fog is evaluated on the basis of the above-described evaluation standards. The saturation is measured by a measuring device (X-Rite 938 manufactured by X-Rite Inc.). The result of the measurement is shown in FIG. 8.

The setting conditions in this test are as follows. The toner T and the test image used in this test are the same as those employed in the foregoing test. The acceptable level of saturation in this test is "less than 3.0".

From the result of this test, in the toner reuse system 50B, the quantity of the retrieved toner Tc to be supplied to the black developing unit 14K from the buffer container 51 is set to achieve 20% or less as the ratio of the retrieved toner to the quantity of the unused black toner to be supplied. Specifically, a control signal is sent to the second carrier driving controller 74 to supply 0.2 times or less as much retrieved toner as the quantity of the unused black toner to be supplied that is recognized in the toner supply unit 30B. Also, in this case, the unused black toner is supplied under a condition that the quantity of the retrieved toner Tc to be supplied is subtracted from the original quantity of supply.

Other Embodiments

In the second embodiment, the color image forming apparatus 1B of a tandem type is described in which the image creating units 10 (Y, M, C, K) of four colors are arranged in series on the intermediate transfer belt 20 along the direction of rotation of the intermediate transfer belt 20. However, color image forming apparatuses of other types than the tandem type can be similarly used as long as the intermediate transfer mode is utilized.

As described above, some embodiments of the invention are outlined below.

According to an aspect of the invention, an image forming apparatus has an image carrier on which an electrostatic latent image is formed, a developing unit that develops the electrostatic latent image by toner, and a cleaning unit that removes toner remaining on the image carrier after the developed toner image is transferred to a recording medium. The image forming apparatus includes a buffer housing unit that temporarily houses the toner removed by the cleaning unit, a first carrier unit that is provided between the cleaning unit and the buffer housing unit and that carries the toner removed by the cleaning unit to the buffer housing unit by a carrier driving member, a second carrier unit that is provided between the buffer housing unit and the developing unit and that carries retrieved toner housed in the buffer housing unit to the developing unit by a carrier driving member, a waste housing unit that is provided to be connected to the buffer housing unit and that causes the retrieved toner exceeding an upper limit of housing capacity of the housing unit to overflow and then houses the overflowed toner, and a control unit that separately controls driving of the carrier driving member of the first carrier unit and driving of the carrier driving member of the second carrier unit.

According to another aspect of the invention, an image forming apparatus has an image carrier on which an electrostatic latent image is formed, a developing unit that develops the electrostatic latent image by toner, an intermediate transfer member that holds the developed toner image by primary transfer and carries the toner image to a secondary transfer unit that performs secondary transfer to a recording medium, and a second cleaning unit that removes toner remaining on the intermediate transfer member after the secondary transfer.

The image forming apparatus includes a buffer housing unit that temporarily houses the toner removed by the second cleaning unit, a first carrier unit that is provided between the second cleaning unit and the buffer housing unit and that carries the toner removed by the second cleaning unit to the buffer housing unit by a carrier driving member, a second carrier unit that is provided between the buffer housing unit and the developing unit and that carries retrieved toner housed in the buffer housing unit to the developing unit by a carrier driving member, a waste housing unit that is provided to be connected to the buffer housing unit and that causes the retrieved toner exceeding an upper limit of housing capacity of the housing unit to overflow and then houses the overflowed toner, and a control unit that separately controls driving of the carrier driving member of the first carrier unit and driving of the carrier driving member of the second carrier unit.

According to another aspect of the invention, the image forming apparatus may have a toner supply unit that supplies unused toner to the developing unit, wherein the control unit may control the driving of the carrier driving member of the first carrier unit synchronously with operation timing of the cleaning unit and may control the driving of the carrier driving member of the second carrier unit synchronously with operation timing of the toner supply unit.

According to another aspect of the invention, the image forming apparatus may have a toner supply unit that supplies unused toner to the developing unit, wherein the control unit may control the driving of the carrier driving member of the first carrier unit synchronously with operation timing of the second cleaning unit and may control the driving of the carrier driving member of the second carrier unit synchronously with operation timing of the toner supply unit.

According to another aspect of the invention, in the image forming apparatus, a removing unit that is driven to remove waste from the retrieved toner housed in the buffer housing unit may be installed in the buffer housing unit.

When the removing unit is provided, the control unit may further control the driving of the removing unit synchronously with the driving timing of the carrier driving member of the first carrier unit.

According to another aspect of the invention, in the image forming apparatus, a stir-driving unit that stirs the retrieved toner housed in the buffer housing unit may be installed in the buffer housing unit.

According to another aspect of the invention, in the image forming apparatus in which the toner supply unit is provided, the control unit may control the driving of the carrier driving member of the second carrier unit to achieve 30% or less as the ratio of the retrieved toner to the quantity of unused toner to be supplied from the toner supply unit.

According to another aspect of the invention, in the image forming apparatus, as the image carrier and the developing unit, plural image carriers and developing units that individually form toner images of plural color components including at least black may be provided, and the first carrier unit may be connected only to a black developing unit that uses black toner, of the plural developing units.

When the foregoing configuration is employed, toner supply units that individually supply unused toner of color components corresponding to each of the plural developing units may be provided, and the control unit may control the driving of the carrier driving member of the second carrier unit to achieve 20% or less as the ratio of the retrieved toner to the quantity of unused black toner to be supplied from the toner supply unit.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The entire disclosure of Japanese Patent Application No. 2005-089793 filed on Mar. 25, 2005 including specification, claims, drawings and abstract is incorporated herein by reference in its entirety.

What is claimed is:

1. An image forming apparatus comprising an image carrier on which an electrostatic latent image is formed, a developing unit that develops the electrostatic latent image using a toner to form a toner image, and a cleaning unit that removes the toner remaining on the image carrier after transferring the toner image to a recording medium, the image forming apparatus comprising:

a buffer housing unit for temporarily housing the toner removed by the cleaning unit;

a first carrier unit comprising a carrier driving member, the first carrier unit provided between the cleaning unit and the buffer housing unit, and the first carrier unit carries the toner removed by the cleaning unit to the buffer housing unit using the carrier driving member;

a second carrier unit comprising a carrier driving member, the second carrier unit provided between the buffer housing unit and the developing unit, and the second carrier unit carries the toner housed in the buffer housing unit to the developing unit using the carrier driving member;

a waste housing unit connected to the buffer housing unit; and a control unit that separately controls the carrier driving member of the first carrier unit and the carrier driving member of the second carrier unit, wherein the buffer housing unit has an upper limit of housing capacity of the toner, and the waste housing unit houses the toner exceeding the upper limit and overflowing from the buffer housing unit.

2. The image forming apparatus as claimed in claim 1, further comprising a toner supply unit that supplies an unused toner to the developing unit, wherein the control unit controls the carrier driving member of the first carrier unit synchronously with the cleaning unit, and controls the driving of the carrier driving member of the second carrier unit synchronously with the toner supply unit.

3. The image forming apparatus as claimed in claim 2, wherein the control unit controls the carrier driving member of the second carrier unit so that the ratio of the toner supplied into the developing unit by the driving member of the second carrier unit and the unused toner supplied into the developing unit by the toner supply unit is 30% or less.

4. The image forming apparatus as claimed in claim 1, wherein the buffer housing unit comprises a removing unit for removing a waste from the toner housed in the buffer housing unit.

5. The image forming apparatus as claimed in claim 4, wherein the control unit further controls the removing unit synchronously with the carrier driving member of the first carrier unit.

6. The image forming apparatus as claimed in claim 1, wherein the buffer housing unit comprises a stir-driving unit that stirs the toner housed in the buffer housing unit.

7. An image forming apparatus comprising an image carrier on which an electrostatic latent image is formed, a developing unit that develops the electrostatic latent image using a toner to form a toner image, an intermediate transfer member that accepts the toner image from the image carrier and transfers the toner image to a recording medium, and a second cleaning unit that removes the toner remaining on the intermediate transfer member after transferring the toner image to the recording medium, the apparatus comprising:

a buffer housing unit that temporarily houses the toner removed by the second cleaning unit;

a first carrier unit comprising a carrier driving member, the first carrier unit provided between the second cleaning unit and the buffer housing unit, and the first carrier unit carries the toner removed by the second cleaning unit to the buffer housing unit using the carrier driving member;

a second carrier unit comprising a carrier driving member, the second carrier unit provided between the buffer housing unit and the developing unit, and the second carrier unit carries the toner housed in the buffer housing unit to the developing unit using the carrier driving member;

a waste housing unit connected to the buffer housing unit; and a control unit that separately controls the carrier driving member of the first carrier unit and the carrier driving member of the second carrier unit, wherein the buffer housing unit has an upper limit of housing capacity of the toner, and the waste housing unit houses the toner exceeding the upper limit and overflowing from the buffer housing unit.

8. The image forming apparatus as claimed in claim 7, further comprising a toner supply unit that supplies an unused toner to the developing unit, wherein the control unit controls the carrier driving member of the first carrier unit synchronously with the second cleaning unit, and controls the carrier driving member of the second carrier unit synchronously with the toner supply unit.

9. The image forming apparatus as claimed in claim 7, wherein the buffer housing unit comprises a removing unit that removes a waste from the toner housed in the buffer housing unit.

10. The image forming apparatus as claimed in claim 9, wherein the control unit further controls the removing unit synchronously with the carrier driving member of the first carrier unit.

11. The image forming apparatus as claimed in claim 7, wherein the buffer housing unit comprises a stir-driving unit that stirs the toner housed in the buffer housing unit.

12. The image forming apparatus as claimed in claim 7, further comprising a plurality of image carriers and a plurality of developing units, at least one of the developing units comprising a black toner, each developing unit forming the toner images individually on the plurality of image carriers, wherein the second carrier unit is connected only to the developing unit containing the black toner.

13. The image forming apparatus as claimed in claim 12, each developing unit comprising the toner supply units that supply the unused toners individually, wherein the control unit controls the carrier driving member of the second carrier unit so that the ratio of the toner supplied into the developing unit by the driving member of the second carrier unit and the unused black toner supplied into the developing unit by the toner supply unit is 30% or less.

* * * * *